US008568087B2

(12) United States Patent
McIntosh et al.

(10) Patent No.: US 8,568,087 B2
(45) **Date of Patent: *Oct. 29, 2013**

(54) DEVICE FOR DETECTING A FRACTURED SHAFT OF A GAS TURBINE AND A GAS TURBINE

(75) Inventors: Alastair McIntosh, Berlin (DE); Christopher Bilson, Berlin (DE)

(73) Assignee: MTU Aero Engines GmbH, Munich (DE)

( * ) Notice: Subject to any disclaimer, the term of this patent is extended or adjusted under 35 U.S.C. 154(b) by 98 days.

This patent is subject to a terminal disclaimer.

(21) Appl. No.: 12/248,392

(22) Filed: Oct. 9, 2008

(65) Prior Publication Data

US 2009/0148270 A1 Jun. 11, 2009

Related U.S. Application Data

(63) Continuation of application No. PCT/DE2007/000609, filed on Apr. 4, 2007.

(51) Int. Cl.
*F01B 25/26* (2006.01)

(52) U.S. Cl.
USPC ..... 415/118; 416/2; 416/61

(58) Field of Classification Search
USPC ..... 416/61, 2; 415/19, 118, 191, 211.2; 60/779, 39.091
See application file for complete search history.

(56) References Cited

U.S. PATENT DOCUMENTS

| | | | | |
|---|---|---|---|---|
| 1,326,867 | A | 12/1919 | Junggren | |
| 5,411,364 | A * | 5/1995 | Aberg et al. | 415/9 |
| 6,179,560 | B1 * | 1/2001 | Kouris et al. | 415/190 |
| 6,607,349 | B2 * | 8/2003 | Mulera et al. | 415/1 |

(Continued)

FOREIGN PATENT DOCUMENTS

| | | |
|---|---|---|
| DE | 1227704 | 10/1966 |
| DE | 19727296 | 1/1999 |

(Continued)

OTHER PUBLICATIONS http://web.archive.org/web/19990508063849/http://www.picotech.com/applications/thermocouple.html. This web page shows the description of thermocouples as it appeared on the web page http://www.picotech.com/applications/thermocouple.html as of May 8, 1999.*

(Continued)

*Primary Examiner* — Edward Look
*Assistant Examiner* — Aaron R Eastman
(74) *Attorney, Agent, or Firm* — McAndrews, Held & Malloy, Ltd.

(57) ABSTRACT

The present technology relates generally to a device for the detection of a shaft fracture in a rotor of a turbine, for example a medium pressure turbine such as a gas turbine, in particular an aircraft engine, whereby at least one stator-side sensor element is positioned downstream from the turbine in the area of a stator-side guide vane ring of another turbine in particular, a low pressure turbine; and whereby a radially inner section of the last rotor-side moving blade ring (as seen in the direction of flow) of the turbine cooperates with at least one sensor element directly and/or proximally in the event of a shaft fracture in the rotor of the turbine to generate an electric signal corresponding to the shaft fracture.

20 Claims, 1 Drawing Sheet

(56) References Cited

U.S. PATENT DOCUMENTS

| | | | | |
|---|---|---|---|---|
| 6,962,043 | B2 * | 11/2005 | Venkateswaran et al. | 60/39.091 |
| 7,002,172 | B2 * | 2/2006 | Rensch | 250/559.45 |
| 2003/0091430 | A1 * | 5/2003 | Mulera et al. | 415/14 |
| 2007/0160457 | A1 * | 7/2007 | Bilson et al. | 415/118 |
| 2008/0069685 | A1 * | 3/2008 | Bilson | 415/118 |

FOREIGN PATENT DOCUMENTS

| | | | |
|---|---|---|---|
| DE | 102004026366 | | 12/2005 |
| DE | 102004026366.3 | * | 12/2005 |
| DE | 102004033924 | | 2/2006 |
| SU | 1229563 | A1 * | 5/1986 |
| WO | WO 2005116406 | A1 * | 12/2005 |
| WO | WO 2006/007056 | | 1/2006 |
| WO | WO 2006005319 | A2 * | 1/2006 |

OTHER PUBLICATIONS

International Search Report corresponding to International Application Serial No. PCT/DE2007/000609, completed Jul. 10, 2007.

Soviet Inventions Illustrated Derwent, Dec. 31, 1986.

* cited by examiner

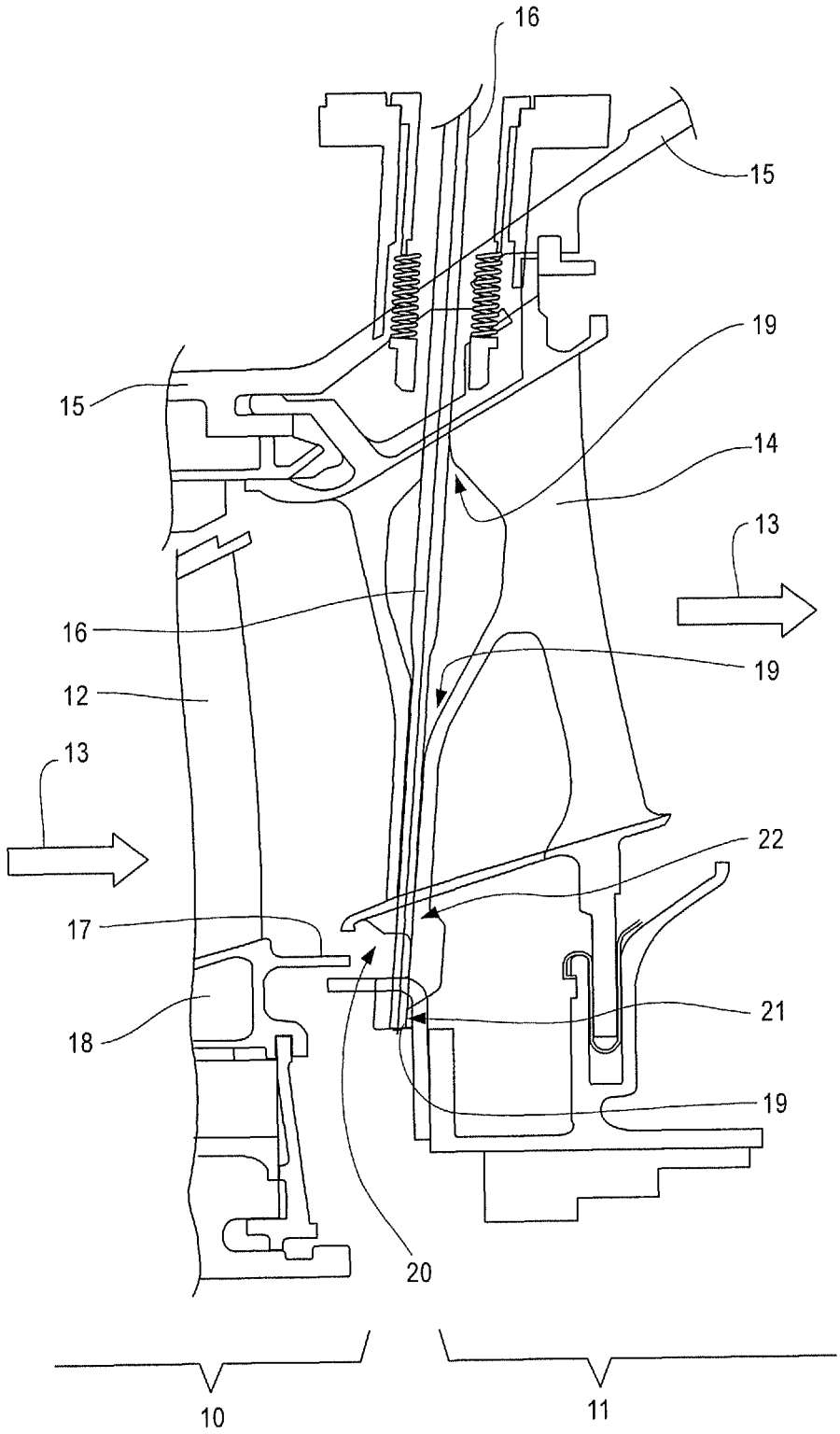
16
15
19
15
14
13
16
19
12
13
22
17
21
18
19
20
10
11

DEVICE FOR DETECTING A FRACTURED SHAFT OF A GAS TURBINE AND A GAS TURBINE

RELATED APPLICATIONS

This application is a continuation of International Application Serial No. PCT/DE2007/000609 (International Publication Number WO 2007/118452), having an International filing date of Apr. 4, 2007 entitled "Einrichtung Zur Detektion Eines Wellenbruchs An Einer Gasturbine Sowie Gasturbine" ("Device For Detecting A Fractured Shaft Of A Gas Turbine And A Gas Turbine"). International Application No. PCT/DE2007/000609 claimed priority benefits, in turn, from German Patent Application No. 10 2006 017 790.8, filed Apr. 15, 2006. International Application No. PCT/DE2007/000609 and German Application No. 10 2006 017 790.8 are hereby incorporated by reference herein in their entireties.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The presently described technology generally relates to a device for detecting a shaft fracture in a gas turbine, in particular on a gas turbine aircraft engine. Furthermore, the present technology also relates to a gas turbine.

Gas turbines designed for aircraft engines typically have at least one compressor, at least one combustion chamber and at least one turbine. Aircraft engines known in the art typically have three compressors positioned upstream from the combustion chamber and three turbines positioned downstream from the combustion chamber. The three compressors of the aircraft engines include a low-pressure compressor, a medium pressure compressor and a high-pressure compressor. The three turbines of the engine include a high-pressure turbine, a medium pressure turbine and a low-pressure turbine. As it is known to those of ordinary skill in the art, rotors of the high pressure compressor and high pressure turbine, of the medium pressure compressor and medium pressure turbine and of the low pressure compressor and low pressure turbine are each connected by a shaft, such that the three shafts are arranged concentrically about each other, such that the shafts are encapsulated one inside the other.

By this arrangement described above, if there is a fracture in the shaft connecting the medium pressure compressor and the medium pressure turbine, then the medium pressure compressor can no longer draw any work or power from the medium pressure turbine, thus establishing an excessive rotational speed on the medium pressure turbine. Such wheel spinning of the medium pressure turbine must be prevented because it can damage the entire aircraft engine.

Thus, for safety reasons, a shaft fracture in a gas turbine must be reliably detectable so that the supply of fuel to the combustion chamber may be interrupted when a shaft fracture occurs. Such detection of a shaft fracture poses problems, particularly if the gas turbine has three concentric and therefore encapsulated shafts, one inside the other, as described above. In particular, the detection of a shaft fracture of the middle shaft connecting the medium pressure turbine to the medium pressure compressor is extremely difficult, and poses even more problems. Similar problems also occur with stationary gas turbines.

DE 10 2004 026 366 A1 describes a device for detecting a shaft fracture in a gas turbine wherein an operating element is arranged radially on the inside of the shaft, between the last rotor-side moving blade ring (as seen in the direction of flow) of a first turbine, and a first stator-side guide vane ring (as seen in the direction of flow) of a second turbine. The operating element cooperates with a transmission element, which extends in the radial direction through the first stator-side guide vane ring (as seen in the direction of flow) of the second turbine. In the case of a shaft fracture, the last rotor-side moving blade ring (as seen in the direction of flow) of the first turbine acts on the operating element, and the impact on the operating element is transmitted via the transmission element to a switch element, which is arranged radially on the outside of the housing of the gas turbine.

BRIEF SUMMARY OF THE INVENTION

The present technology provides a device for detecting a shaft fracture in a gas turbine. This issue is solved by the various embodiments of a device for the detection of a shaft fracture described herein. In certain embodiments of the present technology, a device is described for detecting a shaft fracture in a rotor of a turbine of a gas turbine, whereby at least one stator-side sensor element is positioned downstream from the turbine, and whereby, in a shaft fracture of the rotor of the turbine, a section of a last rotor-side moving blade ring (as seen from the direction of flow) of the turbine cooperates with a sensor element or elements directly and/or proximally to generate an electric signal corresponding to a shaft fracture. The presently described device provides, for example, an effective and relatively simple approach for detecting a fracture in a shaft connecting a turbine to a compressor.

Certain embodiments of the present technology also provide a device, wherein the section (or sections) of the sensor element (or elements) that cooperate with the radial inner section of the last rotor-side moving blade ring of the turbine (as seen from the direction of flow), runs in an area on the radial inside of a flow channel between the last rotor-side moving blade ring (as seen from the direction of flow) of the turbine and the stator unsheathed and/or unprotected, whereby a section connected to this radial inner section and a section of the respective sensor element connected to this radial outer section are arranged in a recess in the stator and are thus sheathed and protected by the stator.

Certain embodiments also present a gas turbine, preferably a gas turbine for an aircraft engine, wherein the gas turbine has a device for detecting a shaft fracture.

BRIEF DESCRIPTION OF SEVERAL VIEWS OF THE DRAWINGS

FIG. 1 shows a section of a gas turbine having a device for detecting a shaft fracture in a gas turbine in accordance with at least one embodiment of the present technology.

DETAILED DESCRIPTION OF THE INVENTION

Without being so limited, an embodiment of the present technology is explained below in greater detail with reference to the drawing of FIG. 1.

FIG. 1 illustrates at least one embodiment of a gas turbine according to the present technology, namely an aircraft engine between a rotor of a medium pressure turbine 10 and a stator of a low-pressure turbine 11. A section of a rotor blade 12 of the last moving blade ring (as seen in the direction of flow (arrow 13)) of the medium pressure turbine 10 is shown downstream from the rotor of the medium pressure turbine 10. A guide vane 14 of the first guide vane ring (as seen in the direction of flow 13) of the low-pressure turbine 11 and a housing section 15 are shown from the stator of the low-pressure turbine 11. The first and/or foremost guide vane ring (as seen in the direction of flow 13) of the low-pressure turbine 11 is thus adjacent to the last and/or rearmost moving blade ring (as seen in the direction of flow 13) of the medium pressure turbine 10. A high-pressure turbine is positioned upstream from the medium pressure turbine 10.

As already mentioned, with gas turbines having three turbines and three compressors, the rotors of the high pressure turbine and the high pressure compressor, the medium pressure turbine and the medium pressure compressor and the low pressure turbine and the low pressure compressor are each joined together by a shaft. These three shafts are placed one inside the other concentrically, and are thus encapsulated one inside the other. It is therefore at least one aspect of the present technology to provide a device in various embodiments for detecting a shaft fracture in a gas turbine, where the device is particularly suitable for detecting a fracture on the shaft connecting the medium pressure turbine rotor to the medium pressure compressor rotor. Namely, if this medium pressure shaft fractures, then the medium pressure compressor can no longer draw work and/or power from the medium pressure turbine, which may result in over-revving of the medium pressure turbine. Since such over-revving of the turbine can cause serious damage to the aircraft engine, a shaft fracture must be reliably detected.

In the area of the first stator-side guide vane ring (as seen in the direction of flow 13) of the low-pressure turbine 11 of FIG. 1, at least one sensor element 16 is positioned. The at least one sensor element 16 acts to detect a shaft fracture with a section 17 of the last rotor-side moving blade ring (as seen in the direction of flow 13) of the medium pressure turbine 10 such that, when there is a shaft fracture, the most posterior or last moving blade ring (as seen in the direction of flow 13) of the medium pressure turbine 10 cooperates directly and/or proximally with the radial inner section 17 of the sensor assembly 16.

In certain embodiments, the at least one sensor element 16, is an electric conductor, which disconnects from the radial inner section 17 of the last moving blade ring (as seen in the direction of flow 13) of the medium pressure turbine 10 in the event of a shaft fracture, thereby generating an electric signal corresponding to the shaft fracture and transmitting the signal to a switch element (not shown). Due to the pressure conditions in a turbine in the event of a shaft fracture of the shaft connecting the medium pressure turbine 10 to the medium pressure compressor (not shown), the rotor of the medium pressure turbine 10 is moved in the direction of flow 13, and thus in the direction of the first guide vane ring of the low-pressure turbine 11. The sensor element 16 designed as a conductor(s) are thus disconnected from the radial inner section 17 of the last moving blade ring (as seen in the direction of flow 13) of the medium pressure turbine 10. The section 17 is designed as a protrusion protruding in the direction of flow on a vane platform 18 of the rotor blade 12 of the last moving blade ring (as seen in the direction of flow 13) of the medium pressure turbine 10.

The sensor element 16 shown in FIG. 1 is guided in a recess 19, which can be, for example, a borehole in a stator-side guide vane 14 of the foremost guide vane ring (as seen in the direction of flow 13) of the low pressure turbine 11, such that the borehole 19 extends essentially in the radial direction of the guide vane 14 and passes through the guide vane 14 in a straight line. The sensor 16 can be inserted from the outside into the borehole 19 of the guide vane 14 and can be removed from the borehole 19 for maintenance purposes and/or for cleaning purposes. The sensor element 16 thus forms a line replaceable unit, which can be uninstalled from the gas turbine and then reinstalled for maintenance purposes without dismantling the gas turbine. This is an advantage over conventional shaft fracture detection devices and systems.

According to FIG. 1, the sensor element 16 extends into a radial inner area of a flow channel, which is formed between the last rotor-side moving blade ring (as seen in the direction of flow 13) of the medium pressure turbine 10 and the first guide vane ring (as seen in the direction of flow) of the low-pressure turbine 11. A section 20 of the sensor element 16, which directly and/or proximally contacts the radial inner section 17 of the last rotor-side moving blade ring (as seen in the direction of flow 13) of the medium pressure turbine 10 and is preferably disconnected in the process, is unsheathed in the flow channel, and is thus exposed to possible contact by the section 17 without protection.

A section 21 connected on the radial inside of this section 20 of the sensor element 16, and a section 22 connected on the radial outside of this section 20 of the sensor element 16 are guided in the borehole 19 of the guide vane 14, and are thus sheathed and protected by the guide vane 14. This ensures that when the section 17 of the rotor blade 12 strikes the section 20 of the sensor element 16 in the event of a shaft fracture, this section 20 of the sensor element 16 is not just bent, but is disconnected from the section 17 of the rotor blade 12. Again, such an outcome is another advantage of the present technology.

As already mentioned, the at least one sensor element 16 is preferably designed as an electric conductor. However, according to at least one preferred embodiment of the present technology, the sensor element 16 (or elements) is designed as a thermocouple (or thermocouples). Such thermocouples can be oxidation resistant, which can be particularly advantageous with respect to the section 20 of the sensor element 16, which is unsheathed or unprotected in the flow channel.

As discussed, a shaft fracture in a low pressure turbine in particular can be detected with the assistance of the sensor element 16 (or elements) such that, when a shaft fracture occurs, the last rotor-side moving blade ring (as seen in the direction of flow 13) of the medium pressure turbine 10 disconnects the section 20 of the sensor element 16 via the section 17 protruding in the direction of flow 13. A corresponding signal indicating a shaft fracture is thereby transmitted from the sensor element 16 to a control unit (not shown), which may interrupt the fuel supply to the combustion chamber of the gas turbine based on this signal to prevent further damage.

With the present technology, a device for detecting of a shaft fracture of a rotor of a gas turbine is described, such that a section of a last moving blade ring (as seen in the direction of flow 13) of the turbine, which is connected to the shaft to be monitored with respect to the shaft fracture, cooperates with at least one sensor element assigned to a stator, in particular to a first guide vane ring (as seen in the direction of flow 13) of a turbine positioned downstream. In the event of a shaft fracture, the (or each) sensor element is penetrated and/or disconnected by the section protruding in the direction of flow of the last moving blade ring (as seen in the direction of flow 13) of the turbine, which is connected to the shaft to be monitored with regard to the shaft fracture.

The present technology has now been described in such full, clear, concise and exact terms as to enable a person familiar in the art to which it pertains, to practice the same. It is to be understood that the foregoing describes preferred embodiments and examples of the present technology and that modifications may be made therein without departing from the spirit or scope of the present technology as set forth in the claims. Moreover, while particular elements, embodiments and applications of the present technology have been shown and described, it will be understood, of course, that the present technology is not limited thereto since modifications can be made by those familiar in the art without departing from the scope of the present disclosure, particularly in light of the foregoing teachings and appended claims. Moreover, it is also understood that the embodiments shown in the drawings, if any, and as described above are merely for illustrative purposes and not intended to limit the scope of the present technology, which is defined by the following claims as interpreted according to the principles of patent law, including the Doctrine of Equivalents. Further, all references cited herein are incorporated in their entirety.

The invention claimed is:

1. A system for detecting a shaft fracture in a rotor of a turbine, the system comprising:

a protrusion positioned in a radially inner section of a last rotor-side moving blade ring of a first turbine and protruding toward a downstream turbine; and a sensor unit positioned in a stator-side guide vane ring of the downstream turbine, the sensor unit having at least one electric conductor, and the sensor unit being a line-replaceable unit that can be uninstalled and reinstalled from the downstream turbine without dismantling the downstream turbine;

wherein, in the event of a shaft fracture in the rotor of the first turbine, the protrusion disconnects the electric conductor of the sensor unit to generate an electric signal corresponding to the shaft fracture event.

2. The system of claim 1, wherein the first turbine is an aircraft engine.

3. The system of claim 2, wherein the first turbine is a medium pressure gas turbine.

4. The system of claim 3, wherein the downstream turbine is a low pressure turbine.

5. The system of claim 1, wherein the electric conductor is a thermocouple.

6. The system of claim 1, wherein the sensor unit is installed into a recess running linearly in the stator-side guide vane ring of the downstream turbine.

7. The system of claim 6, wherein at least a portion of the sensor unit extends into a radial inner area of a flow channel, the flow channel being formed between the last rotor-side moving blade ring of the first turbine and the stator-side guide vane ring.

8. The system of claim 7, wherein a section of the sensor unit is unsheathed or unprotected within the radially inner area of the flow channel.

9. The system of claim 8, wherein the unprotected or unsheathed section of the sensor unit is connected to a second section of the sensor unit on a radial inside portion of the flow channel, wherein the second section of the sensor unit is protected by a stator-side guide vane.

10. The system of claim 9, wherein the unprotected or unsheathed section of the sensor unit is connected to a third section of the sensor unit on a radial outside portion of the flow channel, wherein the third section of the sensor unit is sheathed or protected by a stator-side guide vane.

11. The system of claim 1, further comprising a plurality of sensor units distributed along a length of a rotor of the downstream turbine.

12. The system of claim 11, wherein, in the event of a shaft fracture, the protrusion disconnects the electric conductor of at least one of the sensor units to generate an electric signal corresponding to the shaft fracture event.

13. A gas turbine apparatus comprising:

at least one compressor having at least one combustion chamber, a first turbine including at least one system for detecting a shaft fracture in the rotor of the first turbine wherein the device for the detection of the shaft fracture comprises:

a protrusion positioned in a radially inner section of a last rotor-side moving blade ring of the first turbine and protruding toward a downstream turbine; and a sensor unit positioned in a stator-side guide vane ring of the downstream turbine, the sensor unit having at least one electric conductor, and the sensor unit being a line-replaceable unit that can be uninstalled and reinstalled from the downstream turbine without dismantling the downstream turbine;

wherein, in the event of a shaft fracture in the rotor of the first turbine, the protrusion disconnects electric conductor of the sensor unit to generate an electric signal corresponding to the shaft fracture event.

14. The gas turbine apparatus of claim 13, wherein the first turbine is a medium pressure turbine.

15. The gas turbine apparatus of claim 13, wherein the electric conductor is a thermocouple.

16. The gas turbine apparatus of claim 13, wherein the sensor unit is installed into a recess running linearly in the stator-side guide vane ring of the downstream turbine.

17. The system of claim 16, wherein the sensor unit extends into a radial inner area of a flow channel, the flow channel being formed between the last rotor-side moving blade ring of the first turbine and the first guide vane ring, and further wherein a section of the sensor unit is unsheathed or unprotected within the radially inner area of the flow channel.

18. The gas turbine apparatus of claim 17, wherein the unprotected or unsheathed section of the sensor unit is connected to a second section of the sensor unit on a radial inside portion of the flow channel and to a third section of the sensor unit at a radial outside portion of the flow channel, wherein the second and third sections of the sensor unit are protected by a stator-side guide vane.

19. The system of claim 13, further comprising a plurality of sensor units distributed along a length of a rotor of the downstream turbine.

20. The system of claim 19, wherein, in the event of a shaft fracture, the protrusion disconnects the electric conductor of at least one of the sensor units to generate an electric signal corresponding to the shaft fracture event.

* * * * *